US006923096B1

(12) United States Patent
Kim

(10) Patent No.: US 6,923,096 B1
(45) Date of Patent: Aug. 2, 2005

(54) ADJUSTABLE SOCKET WRENCH

(76) Inventor: Ee Jig Kim, 24558 Stonegate Dr., West Hills, CA (US) 91304

( * ) Notice: Subject to any disclaimer, the term of this patent is extended or adjusted under 35 U.S.C. 154(b) by 73 days.

(21) Appl. No.: 10/678,862

(22) Filed: Oct. 6, 2003

(51) Int. Cl.[7] ..... B25B 13/10

(52) U.S. Cl. ..... 81/129; 81/125; 81/124.4

(58) Field of Search ..... 81/125, 121.1, 81/119, 129, 155, 157, 158, 165, 124.4, 125.1

(56) References Cited

U.S. PATENT DOCUMENTS 1,697,764 A * 1/1929 Heinz ..... 81/167
1,954,141 A * 4/1934 Miquelon ..... 81/124.3
5,724,872 A * 3/1998 Shih ..... 81/125
5,953,968 A * 9/1999 Macor ..... 81/119
5,960,681 A * 10/1999 Anderson et al. ..... 81/125
6,220,124 B1 * 4/2001 Perkins ..... 81/174
6,609,401 B1 * 8/2003 Iskhakbayev ..... 70/225

* cited by examiner

*Primary Examiner*—Jacob K. Ackun, Jr.
(74) *Attorney, Agent, or Firm*—J. E. McTaggart

(57) ABSTRACT

An adjustable hex wrench structure, in its basic embodiment, requires only two parts: a main body configured with a socket cavity having special modified hex cross-sectional shape, and a clamping screw, traversing a wall of the main body, for securing a hex fastener in place in the socket cavity. In socket wrench embodiments the main body is made cylindrical in shape and configured with a square driver opening to engage the square end of a conventional socket driver shaft. In a dual socket wrench version, two different-sized socket cavities, one in each end region of the main body, provide an overall 2:1 size range: e.g. ¾" to ⅜"; the square driver opening is configured in a central bulkhead in the main body so that, whichever socket cavity is deployed to drive a hex fastener, the square end of the driver shaft can be inserted through the other socket cavity, at the opposite end of the main body, to engage the square driver opening.

13 Claims, 2 Drawing Sheets

ADJUSTABLE SOCKET WRENCH

FIELD OF THE INVENTION

The present invention relates to the field of hand tools and more particularly the field of hand-operated wrenches for driving hexagonal nuts and bolt-heads of various sizes, which conventionally requires large sets of graduated fixed-size sockets or box-end wrenches. The present invention discloses a simple two-piece basic wrench structure with a novel socket cavity shape and a clamping screw that can be readily adjusted to accommodate a wide range of sizes of hex fasteners, thus enabling a single or dual unit to avoid the need for a substantial quantity of different sized fixed sockets or box-end wrenches.

BACKGROUND OF THE INVENTION

Conventional fixed wrenches, whether of the spanner, box-end or the socket type that snap onto a square driver shaft, have the disadvantage that a large number of different sized wrenches or sockets are required to cover a working size range of hex fasteners. For example in the inch system, the range from ⅜ to ¾ inches (0.375" to 0.750") requires seven sockets in steps of 1/16" or thirteen sockets in steps of 1/32"; and, in the numbered metric system, the range from 10 mm to 20 mm (0.394" to 0.787") requires eleven sockets in steps of 1 mm.

As substitutes for single or dual fixed spanner wrenches, adjustable spanners such as "monkey wrenches" and pipe wrenches have been well known and widely used for many years. However such adjustable spanners effectively engage only two of the six facets of hex fasteners and thus tend to fail and/or damage the fastener when high torque is required and applied, whereas box-end or socket wrenches engage all six facets of the hex fastener, distributing the torque and associated forces more evenly, and are thus capable of higher torque with less likelihood of failure or fastener damage.

As substitutes for single or dual fixed box-end wrenches, which engage all six facets of hex fasteners, socket wrench systems, wherein any of an assortment of sockets can be snapped onto the square end of a drive shaft driven by a ratchet handle, have become highly popular, especially to professional mechanics, for their convenience and versatility and are readily available either in individual pieces or in sets of various sizes required to accommodate a desired size range. However, the large number of pieces required is a disadvantage to many occasional users such as typical homeowners who may have only occasional need for a wrench but the required size is unpredictable.

DISCUSSION OF KNOWN ART

U.S. Pat. No. 4,798,108 to Wilson for an ADJUSTABLE SOCKET-FORMING DEVICE discloses a hex socket wrench structure having a cylindrical main body, configured at one end with four facets of a hexagon, in which a radially sliding jaw member is configured in one end region with the other two facets of the hexagon while the opposite end region of the jaw member is threadedly engaged by a screw, radially traversing an opposite side of the main body in a mid region thereof, by which the jaw member can be tightened onto a hex fastener that is to be driven.

U.S. Pat. No. 4,967,625 to Kolari & Kolari discloses an ADJUSTABLE JAW SOCKET having a fixed jaw configured to grip a first adjacent pair of hex faces of a fastener and a slidingly-constrained worm-driven jaw configured to grip a second and opposite adjacent pair of hex faces of the fastener.

Both of the above described devices have the disadvantage of complexity: requiring at least three separate parts of which two demand high precision machining to form complementary channels for accurately constraining the sliding movement.

U.S. design Pat. No. 338,146 to Gramera shows an EQUILATERAL TORQUE DRIVE DOUBLE ENDED SOCKET WRENCH FOR HEXAGONAL FASTENERS of generally tubular shape having a central bulkhead configured with a square opening for engagement by a driver from either end, and also configured externally with a central hex collar as an alternative driving means. Two different sized sockets are provided, one at each end, each of generally triangular shaped for engaging three of the six sides of a hex fastener. This approach offers the advantage of simple one-piece construction with no moving parts, however, in tradeoff, the range of hex fastener sizes accommodated, while not specified in this design patent, appears to be limited to two sizes or, at most, two very narrow ranges.

OBJECTS OF THE INVENTION

It is a primary object of the present invention to provide a simple, strong, compact and economical adjustable hex wrench structure that accommodates a predetermined size range of hex fasteners such as nuts and bolt head, as an alternative to a graduated set of fixed hex box-end or socket wrenches.

It is a further object to provide an adjustable socket wrench embodiment for use with a conventional ratchet or fixed handle driver with a shaft having a square end for engaging the socket.

It is a further object to provide a dual embodiment of the adjustable socket wrench that accommodates all sizes of hex fasteners within an overall size range having a 2:1 ratio.

SUMMARY OF THE INVENTION

The foregoing objects have been met in the present invention of an adjustable socket wrench for hex fasteners, which in its basic embodiment, consists of only two parts: (1) a main body configured with a socket cavity having a special modified hex cross-sectional shape characterized by two oversized facets flanking an undersized facet and (2) a clamping screw, threadedly engaged in a radial bore traversing a wall of the main body diametrically opposite the undersized facet, the screw being configured at its outer end with a diametric drive bar for tightening against the driven hex fastener either by hand or a simple spanner tool.

In a basic socket wrench embodiment, the main body is made cylindrical in shape and configured with a square driver opening to engage the square shaft of a conventional socket driver of the ratchet or fixed type.

A dual socket embodiment is configured with two different-sized socket cavities, one in each end region of the cylindrical main body. The two socket cavities, each fitted with a corresponding clamping screw, can be dimensioned to provide two complementary ranges that will accommodate all hex fasteners sizes in a total range covering a 2:1 ratio: e.g. ¾ to ⅜ inch. The square driver opening is located in a centrally located bulkhead so that, whichever one of the two socket cavities is selected to drive a hex fastener, the square end of a conventional socket driver shaft can be inserted through the other socket cavity at the opposite end region of the main body and engaged into the square driver opening in the bulkhead to drive the adjustable socket in essentially the same manner as a conventional fixed socket.

BRIEF DESCRIPTION OF THE DRAWINGS

The above and further objects, features and advantages of the present invention will be more fully understood from the following description taken with the accompanying drawings in which.

DETAILED DESCRIPTION

Figure 1:
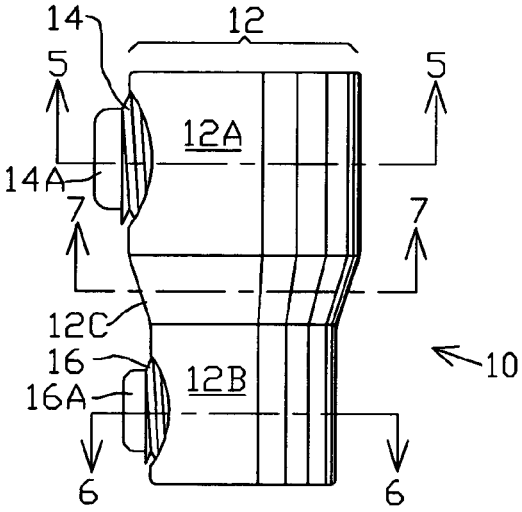
FIG. 1 is an elevational side view of a dual adjustable socket wrench in a preferred embodiment of the present invention.

In FIG. 1, an elevational side view of a dual adjustable socket wrench 10 in a preferred embodiment of the present invention, there are three component parts: a generally cylindrical main body 12 into which a first clamping screw 14 is threaded radially into the larger end portion 12A of main body 12 (in the upper region thereof as shown), and a second clamping screw 16, smaller than screw 14, is threaded into the smaller end portion 12B of main body 12 (in the lower region thereof as shown). In the central portion 12C, the diameter of the main body 12 tapers from that of large end portion 12A to that of small end portion 12B. Clamping screws 14 and 16 are each configured with a drive bar 14A and 16A respectively, extending outwardly as shown, by which the clamping screws 14 and 16 can be rotated manually or by a small wrench.

Figure 2:
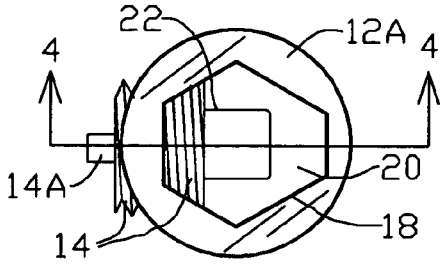
FIG. 2 is a top view of the socket wrench of FIG. 1.

In FIG. 2, a top view of the socket wrench 10 of FIG. 1, the larger end portion 12A is seen configured with a first specially shaped six-sided socket cavity 18, into which the first clamping screw 14 is threadedly engaged at the left hand side as shown. Cavity 18 extends inwardly to a transverse bulkhead 20 which forms a web or partition in the central region of the socket, and which is configured with a square drive opening 22 for engaging a conventional socket driver shaft, ⅜ inch square in this embodiment.

Figure 3:
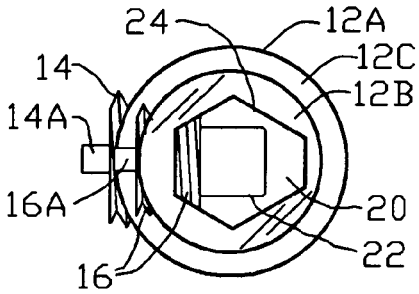
FIG. 3 is a bottom view of the socket wrench of FIG. 1.

In FIG. 3, a bottom view of the socket wrench 10 of FIG. 1, the second end portion 12B is configured with a second six-sided socket cavity 24, the same general shape as the first socket cavity 18 (FIG. 2), but smaller in size, fitted with the second clamping screw 16, and extending inwardly to the opposite side of bulkhead 20 in which the square opening 22 can be accessed from either end while the opposite end is deployed for driving a hex fastener such as a nut or bolt head.

Figure 4:
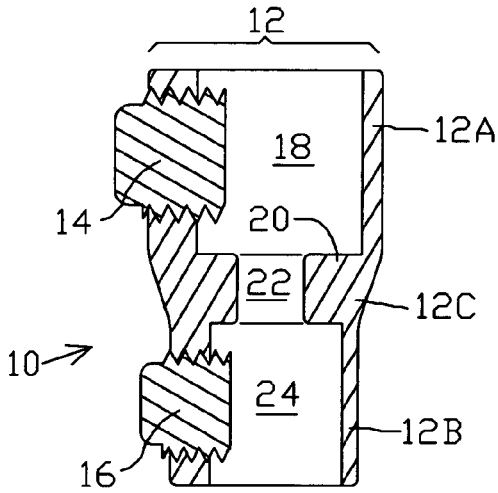
FIG. 4 is a cross-section taken through axis 4—4 of FIG. 2.

FIG. 4, a cross-section taken through axis 4—4 of FIG. 2, provides an elevational view of the adjustable socket wrench 10 corresponding to FIG. 1, showing the internal locations and shapes of first socket cavity 18 with the first clamping screw 14 in the first end 12A, the second (smaller) cavity 24 with the second clamping screw 16 in the second end 12B, and bulkhead 20 and its square drive opening 22 in the central region 12C.

Figure 5:
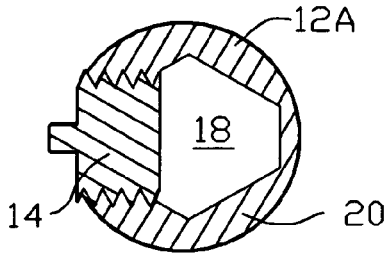
FIG. 5 is a cross-section taken through axis 5—5 of FIG. 1.

FIG. 5, a cross-section taken through axis 5—5 of FIG. 1, corresponds to FIG. 2 in showing the location of first (larger) clamping screw 14 and shape of first (larger) socket cavity 18 in the first end region 12A.

Figure 6:
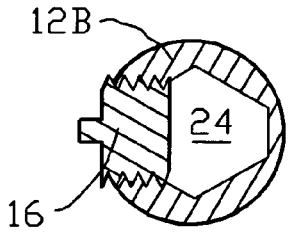
FIG. 6 is a cross-section taken through axis 6—6 of FIG. 1.

FIG. 6, a cross-section taken through axis 6—6 of FIG. 1, corresponds to FIG. 3, showing the location of second (smaller) clamping screw 16 and the shape of the second (smaller) socket cavity 24 in the second end region 12B.

Figure 7:
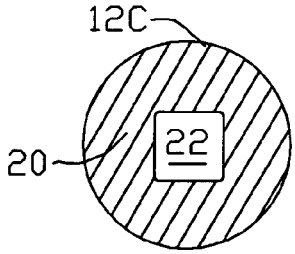
FIG. 7 is a cross-section taken through axis 7—7 of FIG. 1.

FIG. 7, a cross-section taken through axis 7—7 in the central region 12C of main body 12 in FIG. 1, shows the square shape of the drive opening 22 configured in bulkhead 20.

Figure 8:
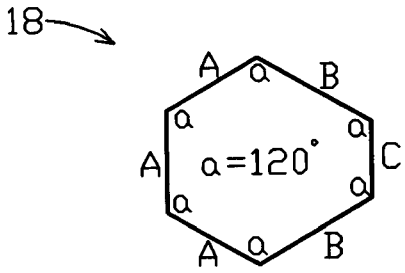
FIG. 8 depicts the modified hex shape of the socket cavities in FIGS. 2, 3, 5 and 6.

FIG. 8 depicts an enlarged view of a socket cavity shaped in the modified hex pattern which is a key aspect of the present invention. As in the regular equilateral hex pattern, all six angles a in the modified hex pattern are 120 degrees as indicated. However, in the modified hex pattern, in a departure from a regular equilateral hexagon with six equal-sized facets, the modified hex pattern is characterized by three of the six facets, on the left hand side as shown, being made equal, having in common the regular standard dimension A, while on the right hand side there are three non-standard-sized facets: two non-adjacent facets of dimension B (larger than A) flanking the third facet of dimension C (smaller than A).

The regular facet width A sets the maximum size hex fastener that can be accommodated; the smallest facet width C sets the minimum size, at which the fastener is engaged by a 3 facet constraint pattern in the main body. Thus the range of fastener sizes that can be accommodated in one modified hex socket cavity is the ratio A/C (>1).

From trigonometry, in a regular hex fastener of size D (distance between parallel facets) each facet width $A=D/(2*\cos 30)$ i.e. $D*0.57735$; in the modified hex shape of this invention, once C is designated to set the range, B can be calculated: $B=2*A-C$.

For a dual wrench, the size ranges of the two socket cavities would normally be made complementary to each other to maximize the continuous overall hex fastener size range: thus for a size range ratio D1/D2 in the larger socket cavity, the size range ratio for the smaller socket cavity is made to be D2/D3 for a total range ratio D1/D3. Size D2 is termed the crossover size, being at the low end of the higher range and at the high end of the lower range.

In a geometrically balanced configuration, the two cavities are made identical in shape but proportioned in size by a cavity size ratio D1/D2=D2/D3 so that each cavity covers the same size ratio, i.e. the square root of the total range ratio. For a 2:1 total range ratio the cavity size ratio is $1.4142:1.(\sqrt{2}:1)$; for a total range of ¾" to ⅜" hex fastener size, the crossover hex fastener size $D2=D1/\sqrt{2}=0.75"/1.4142=0.53033"$. The calculated dimensions of the two socket cavities are:

TABLE I

| Balanced crossover |
|---|
| Upper range D1/D2 = .75"/0.53033" = 1.4142 ($\sqrt{2}$) |
| Lower range D2/D3 = 0.53033"/0.375" = 1.4142 ($\sqrt{2}$), |
| Total range D1/D3 = 1.4142 * 1.4142 = 2.0 |
| A1 = 0.4330" B1 = 0.5598" C1 = 0.3062" |
| A2 = 0.3062" B2 = 0.3959" C2 = 0.2165" |
| Facet width ratio (cavities 1 and 2): A1/C1 = A2/C2 = 1.4142 = $\sqrt{2}$ |

For the preferred embodiment of the invention with a desired overall fastener size range, ¾" to ⅜" (2:1 size range ratio), since the balanced crossover size (D2=0.53033") does not fall on a standard size in the U.S. "inch" system of hex fastener sizes, the crossover size is chosen to be a popular hex fastener size: 9/16" (0.5625"). In this small departure from the above-described balanced configuration, the calculated range and dimensions of the two socket cavities are:

TABLE II

| Crossover hex size = 9/16" |
|---|
| Upper range D1/D2 = .75"/0.5625" = 1.333 |
| Lower range D2/D3 = 0.5625"/0.375" = 1.5 |
| Total range D1/D3 = 1.333 * 1.5 = 2 |
| A1 = 0.4330" B1 = 0.5412" C1 = 0.3248" |
| A2 = 0.3248" B2 = 0.4330" C2 = 0.2165" |
| Facet width ratio (cavity 1): A1/C1 = 0.4330"/0.3248" = 1.333 |
| Facet width ratio (cavity 2): A2/C2 = 0.3248"/0.2165" = 1.5 |

Figure 9:
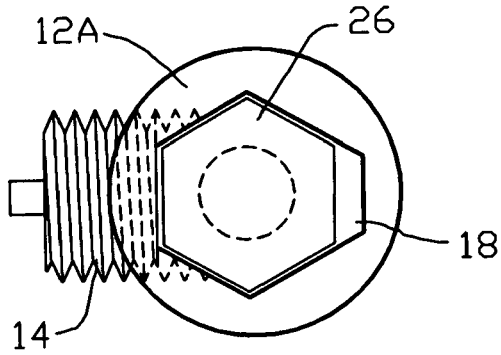
FIG. 9 depicts deployment of a socket cavity engaging a hex fastener of maximum size.
Figure 10:
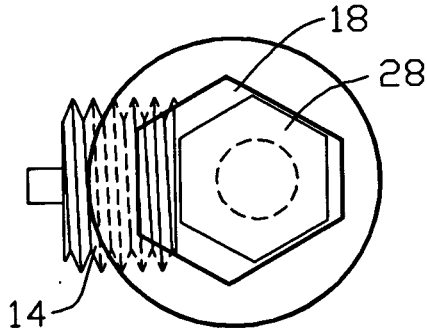
FIG. 10 depicts deployment of a socket cavity engaging a hex fastener of intermediate size.
Figure 11:
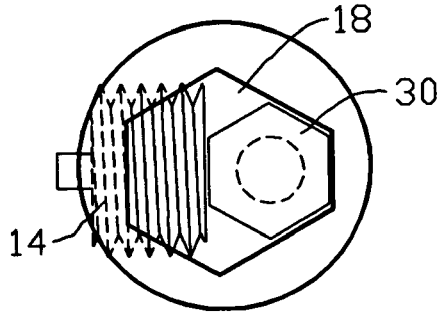
FIG. 11 depicts deployment of a socket cavity engaging a hex fastener of minimum size

FIGS. 9–11, in the same enlarged scale as FIG. 8, illustrate how fasteners of maximum, intermediate, and minimum size respectively, within the working range are engaged between corresponding constraint patterns of facets in the modified hex cavity 18 and the clamping screw 14. The circle shown in broken lines represents either the threaded shaft of a hex bolt or the threaded bore of a hex nut.

FIG. 9 depicts deployment of the first socket cavity 18 engaging a ¾" hex fastener 26, which is the maximum size accommodated in the designated higher range. Clamping screw 14 is set to its most outward working location. In this special case of maximum size fastener, cavity 18 engages five of the six facets of the hex fastener 26, and could satisfactorily drive the ¾" fastener 26 much in the manner of a conventional hex socket cavity, even without benefit of tightening the clamping screw 14, which could be considered preferable but optional in this case but necessary for all smaller hex fastener sizes.

FIG. 10 depicts deployment of first socket cavity 18 engaging a hex fastener 28 of an intermediate size, i.e. between the maximum size (¾") and the minimum size (9/16") for this cavity. Clamping screw 14 is tightened against the left hand facet of hex fastener 28, forcing two other facets against the constraint pattern formed by facets B (FIG. 8) of socket cavity 18, thus engaging three of the six facets of the hex fastener 28.

FIG. 11 depicts deployment of first socket cavity 18 engaging a hex fastener 30 which is of the minimum size (9/16") for this cavity. Tightening the clamping screw 14, which is near the inward limit of its range, forces three facets of fastener 30 against the constraint pattern formed by the three cavity facets, thus engaging four facets of hex fastener 30.

For light duty driving, a hex fastener smaller than the minimum size shown in FIG. 11 could be driven by engagement of two facets only: the end of the clamping screw and facet C (FIG. 8).

While FIGS. 9–11 have been described in connection with the first socket cavity 18, they are equally illustrative of the second socket cavity 24 for which the size shown in FIGS. 9–11 represents slightly increased enlargement due to the smaller size of cavity 24, accommodating hex fasteners ranging in size from 9/16" down to ⅜".

The main body 12 (FIGS. 1–6) and the clamping screws 14 and 16 are machined preferably from high grade tool steel. In the illustrative embodiment, the first end 12A is made 1.25" in diameter and the second end 12B is made 1.0" in diameter. The total length is made 2.25" and the square drive opening 22 is made ⅜" per side: a popular size for conventional driving tools.

Although the illustrative embodiment is arranged and dimensioned as described, the invention can be practiced in any size with dimensional variations as matters of design choice, by allowing acceptable amounts of variations in the cavity size ratio and the facet size ratios in each socket cavity.

As an alternative to the dual-cavity unit described, a single cavity version could be made, for example in FIG. 1 by simply eliminating the smaller sized portion 12B so that the driving opening 22 would then be at one end of the socket in the same manner as in conventional socket wrenches. Optionally the taper in region 12C could be eliminated to make the outer surface fully cylindrical.

The clamping screws 14 and 16 could be made with alternative driving systems instead of bars 14A and 16A, for example finger wings, screwdriver slot or socket (e.g. Philips), square socket or hex socket for Allen wrench.

The general proportions can be altered, for example the outer diameter can be increased to provide increased wall thickness around the cavities, which would increase the ultimate strength.

The invention could be practiced with different types and sizes of driving system as alternative to the ⅜" square opening 22 in the central bulkhead 20, e.g. ½" square may be preferred for larger sized embodiments. The shape could be made rectangular, triangular, hex or other driving shape to match a complementary driver, as a matter of design choice. Instead of rotational drive via the internal driving opening as described, the adjustable socket wrench could be driven externally by a gripping device such as a pipe wrench or a self-clamping wrench of the type utilized for installing and removing cylindrical oil filters. Alternatively, the exterior could be configured with a square, hex or other pattern to be engaged for rotation by a corresponding wrench type.

As alternatives to the socket wrench type embodiments described, the modified hex shape of the socket cavity and the clamping screw, as principles of the present invention, can be practiced in the form of a box-end style wrench by the addition of a driving handle extending radially from the cylindrical main body, forming in effect a box-end wrench style which may be implemented with one or two adjustable sockets. A double-ended version of the box-end wrench can be made by incorporating two cylindrical main bodies, one at each end of a handle. Each main body can be made with one or two adjustable sockets, thus a double-ended box-end wrench can be made with a total of two, three or four adjustable sockets of the present invention, providing expanded overall hex size ranges accordingly.

The invention may be embodied and practiced in other specific forms without departing from the spirit and essential. characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. An adjustable wrench structure for engaging and rotationally driving conventional hex fasteners including hex-head bolts and hex nuts of any size within in a predetermined size range, comprising:

a main body configured with at least one socket cavity having a special modified hex cross-sectional shape characterized by a group of three adjacent standard-sized facets and a group of three non-standard-sized facets consisting of an undersized facet and two equally oversized facets flanking the undersized facet, the main body being configured with a threaded radial bore traversing a wall thereof diametrically opposite the undersized facet:

a clamping screw, threadedly engaged in the radial bore of the main body, made and arranged to engage a hex fastener, inserted into the socket cavity, for purposes of rotationally driving the hex fastener, by applying a clamping force, generated by rotationally tightening the clamping screw, to a facet of the hex fastener and thus forcing at least one other facet of the hex fastener against a corresponding main body constraint pattern formed by at least one of the non-standard-sized facets of the socket cavity: and driving means for receiving rotational driving torque from a driving tool to be transmitted via said main body to a driven hex fastener located in the socket cavity.

2. The adjustable socket wrench as defined in claim 1 wherein said main body is generally cylindrical in shape having a first end region and a second end region opposite the first end region;

said socket cavity is located in the first end region of said main body; and said driving means comprises said main body being configured with a drive cavity of square cross-section, located coaxially at the second end region of the main body, made and arranged to engage a square end portion of a conventional socket wrench driving tool.

3. The adjustable socket wrench as defined in claim 1 wherein said clamping screw is configured, at an end thereof outermost from the socket cavity, with a diametrically disposed drive bar, made and arranged to facilitate manual rotation of said clamping screw for loosening and tightening purposes.

4. The adjustable socket wrench as defined in claim 1 in a dual embodiment comprising, in addition to said socket cavity and said clamping screw located at a first end region of said main body:

a second socket cavity, generally similar to but smaller in size than said first socket cavity, located in a second end region of said main body, made and arranged to complement said first socket cavity and thus enable the adjustable socket wrench to accommodate an overall size range of hex fasteners greater than that of a single socket cavity;

a second clamping screw, associated with said second socket cavity, located and structurally related thereto in the same manner as said first clamping screw relative to said first socket cavity; and said driving means being implemented as a transverse bulkhead, disposed centrally in said main body between said first socket cavity and said second socket cavity, configured with a generally coaxial square opening made and arranged to drivingly engage a square end portion of a conventional socket wrench driving tool, such that, whichever socket cavity is selected for deployment to drive a hex fastener inserted therein, the square end portion of the conventional socket wrench driving tool may be inserted through the other socket cavity at the opposite end region of the main body and engaged into the square opening to rotationally drive the adjustable socket wrench.

5. The adjustable socket wrench in a dual embodiment as defined in claim 4 wherein:

each of said first and second clamping screws is configured, at an end thereof outermost from the corresponding socket cavity, with a diametrically disposed drive bar, made and arranged to facilitate manual rotation of the clamping screw for purposes of tightening and loosening thereof.

6. The adjustable socket wrench in a dual embodiment as defined in claim 5 wherein said second clamping screw is made smaller than said first clamping screw.

7. The adjustable socket wrench in a dual embodiment as defined in claim 4 wherein the first end region of the main body is made to have a first diameter, the second and opposite end region is made to have a second diameter, smaller than the first diameter, and a central region of the main body is configured to taper from the diameter of the first end region to the diameter of the second end region.

8. The adjustable socket wrench in a dual embodiment as defined in claim 4 wherein the overall size range is made to have a 2:1 ratio.

9. The adjustable socket wrench in a dual embodiment as defined in claim 8 wherein the predetermined nominal facet-size ratio for each of the first and second socket cavities is made to be approximately $\sqrt{2}$:1, i.e. 1.414:1, and the predetermined nominal cavity-size ratio is also made to be approximately $\sqrt{2}$:1 i.e. 1.414:1, thus providing the total nominal size range of 2:1.

10. The adjustable socket wrench in a dual embodiment as defined in claim 8 wherein the first socket cavity is dimensioned to accommodate hex fasteners in a nominal size range from ¾" to 9/16" (0.75" to 0.5625") and the second socket cavity is dimensioned to accommodate hex fasteners in a nominal size range from 9/16" to ⅜" (0.5625" to 0.375").

11. The adjustable socket wrench in a dual embodiment as defined in claim 7 wherein said main body is made to have a nominal diameter of 1.25" in the first end region and a nominal diameter of 1.0" in the second end region.

12. The dual adjustable socket wrench as defined in claim 11 wherein said main body is made to have a nominal total length of 2.25" and the square drive opening is made ⅜" nominal per side.

13. The dual adjustable socket wrench as defined in claim 8 wherein the first socket cavity is dimensioned to accommodate hex fasteners in a nominal size range from 20 mm to 14 mm (0.787" to 0.551") and the second socket cavity is dimensioned to accommodate hex fasteners in a nominal size range from 14 mm to 10 mm (0.551" to 0.394").

* * * * *